United States Patent [19]

Reynolds

[11] Patent Number: 4,909,129

[45] Date of Patent: Mar. 20, 1990

[54] GUN LOCK AND GAS OPERATING SYSTEM

[76] Inventor: George L. Reynolds, Rte. 1, Altona, Ill. 61414

[21] Appl. No.: 251,311

[22] Filed: Sep. 30, 1988

[51] Int. Cl.[4] ..... F41D 5/10

[52] U.S. Cl. ..... 89/191.01; 89/193; 89/187.01

[58] Field of Search ..... 89/191.01, 193, 187.01, 89/187.02

[56] References Cited

U.S. PATENT DOCUMENTS

| | | | |
|---|---|---|---|
| 960,825 | 6/1910 | Colleoni . | |
| 2,887,013 | 5/1959 | Marsh . | |
| 2,951,424 | 9/1960 | Stoner . | |
| 3,675,534 | 7/1972 | Beretta . | |
| 4,213,261 | 7/1980 | Claypool . | |
| 4,765,224 | 8/1988 | Morris | 89/191.01 |

FOREIGN PATENT DOCUMENTS

| | | | |
|---|---|---|---|
| 2326527 | 12/1974 | Fed. Rep. of Germany | 89/187.02 |
| 589475 | 5/1925 | France | 89/191.01 |
| 507861 | 6/1939 | United Kingdom | 89/187.02 |

*Primary Examiner*—Harold J. Tudor
*Assistant Examiner*—Stephen Johnson
*Attorney, Agent, or Firm*—Robert O. Richardson

[57] ABSTRACT

A lock and gas operating system for a weapon wherein propellant gas is trapped in an expansion chamber and then released by an actuator valve. The primary-secondary mass relationship in prior art devices is eliminated in this system which has no secondary mass. A reduction in weight and an increased cyclic rate are principle advantages.

8 Claims, 4 Drawing Sheets

GUN LOCK AND GAS OPERATING SYSTEM

BACKGROUND OF THE INVENTION

Conventional gas operated weapons have a primary mass that is driven by gas tapped from the weapon bore through a port. This primary mass which typically is a piston or is operated by the piston, provides the kinetic energy and mechanical means for unlocking the bolt and driving the combined primary mass and secondary mass (bolt) rearwardly. This combination provides the kinetic energy and mechanical means for performing the functioning cycle of the mechanism, whereby a spent cartridge is ejected, a fresh cartridge is chambered and the firing pin placed at ready for triggering the next firing.

Gas operating systems can be designed to be strong yet light weight and which employ the highest pressure cartridges, but the weight to which the gas operating system can be reduced has heretofore been limited by the relationship between the primary and secondary masses. The smallest weight of the secondary mass (bolt) is limited by its several functions, i.e., locking carrying the firing pin, extractor, ejector, etc. Once the seondary mass is determined, the primary mass, which typically is a piston or is operated by the piston, is largely dictated by the ratio which must be provided between the two masses.

SUMMARY OF THE PRESENT INVENTION

The primary-secondary mass relationship in prior art devices is eliminated by the present invention which has no secondary mass, resulting in gas operated mechanisms with a high cyclic rate and which are very strong yet compact and lighter in weight. With no separate secondary mass, there is no need for guide or support means for it, further reducing the weight. A reduction in weight and an increased cyclic rate are two principle advantages of the present invention. While employed in a pistol, the invention may also be applied in rifles, submachine guns, shotguns, grenade launchers and automatic cannons.

A further advantage of this inventive system over systems using conventional gas ports is that this system will accept lead bullets and bullet lubricant much better. In conventional systems where gas ports are drilled directly into the barrel, lead and bullet lubricant are shaved off the bullet in passing the gas port. These enter and foul the gas system. In the present invention the gas enters the gas system on the opposite side of the actuator from where any lead or lubricant would appear. The momentum of the lead and bullet lubricant carries these materials past the gas port, preventing them from entering the gas port.

Briefly, the present invention utilizes the trapping of gas in an expansion chamber and then timing its release to directly drive the bolt, eliminating the primary-secondary mass relationship of conventional gas operating systems which have a lower cyclic rate. This permits the production of high cyclic rate gun mechanisms which, coupled with burst limiters, improves hit probability and conserves ammunition. Everything else being equal, the higher the cyclic rate, the smaller the shot group dispersion within the burst. A small shot dispersion is a goal of armament innovators. The practical upper limit of cyclic rate for single barrel guns firing rifle size cartridges is about 35 rounds per second. At this high cyclic rate, weapon recoil velocities of the primary mass have exceeded 50 feet per second.

The preferred embodiment in which the present invention is practiced is a pistol having a bolt connected to an actuator by a locking member. This actuator is not a primary mass but a valve which times and regulates the action of the gas on the bolt which is the primary mass. As opposed to prior art devices the bolt is the primary mass and there is no secondary mass. As the bullet leaves the barrel the driving gases enter a collection chamber where they drive the actuator rearwardly. This causes an angled surface on the actuator to lift the locking member from contact with the bolt. This permits the gases to drive the bolt rearwardly relative to the barrel and thus actuate the next cycle.

DETAILED DESCRIPTION OF DRAWINGS

Figure 1:
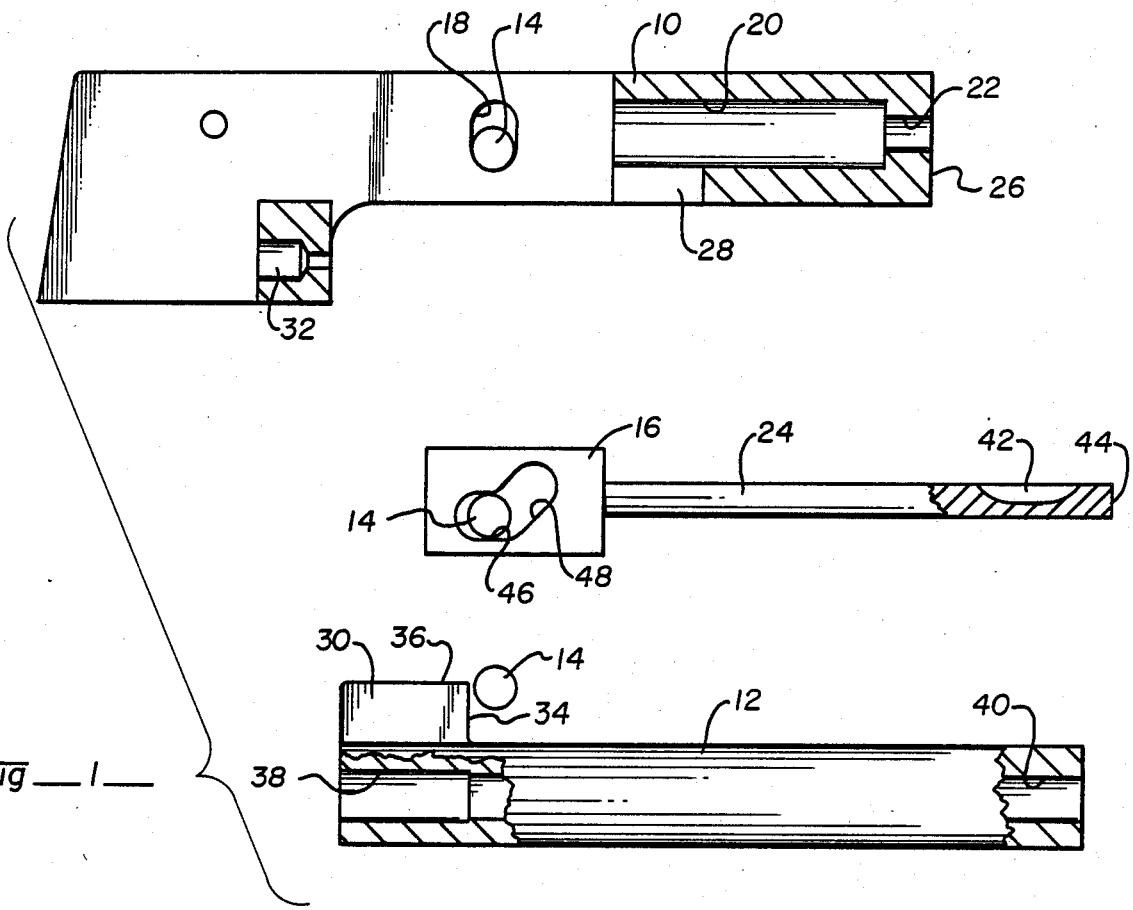
FIG. 1 is an exploded view, partly in section, of the bolt, actuator and barrel, showing the locking member in its locked position relative to the three parts.

Before describing the operation of the parts under the influence of gas pressure upon firing of a bullet from a piston or other gun barrel, reference is made to FIG. 1 for showing the locking of the bolt 10 against relative movement with the barrel 12 by the locking member 14, and its release by rearward movement of the actuator cam 16 to permit rearward movement of the bolt, relative to the barrel. As shown in the exploded view in FIG. 1, the locking member 14 is shown three times, once each relative to the three parts associated with it, bolt 10, barrel 12 and actuator 24.

Bolt 10 has a vertically oriented slot 18 in its housing which permits locking member 14 to move vertically. Locking member 14 is shown at the bottom of the slot 18. Forwardly of slot 18 is a cylindrical cavity 20 with a reduced opening 22 at its outer end. As will be seen hereinafter, this opening 22 receives the stem of actuator 24 which moves longitudinally therein as bolt 10 moves back and forth. Around opening 22 is a forward surface 26 which receives gas pressure as will be described later. Bolt 10 also has a cut out portion 28 to accommodate the locking lug 30 on barrel 12 when bolt 10 moves rearwardly relative to the barrel 12. For orientation purposes bolt 10 shows in section a chamber 32 where a firing pin, not shown, is positioned to strike a chambered cartridge casing primer.

Barrel 12 has a locking lug 30. The locking member 14 bears against its forward edge 34, as shown, when the locking member 14 is at the bottom of slot 18. When the locking member 14 is moved upwardly in slot 18 of bolt 10 it clears the top 36 of lug 30 and permits bolt 10 to move rearwardly relative to the barrel. When bolt 10 moves forwardly again, locking member 14 falls down in slot 18 and against front surface 34 of lug 30, again locking the bolt and barrel together. Cartridge chamber 38 and bore 40 are shown in section for orientation purposes.

Actuator 24 has a stem with a groove 42 near its outer end 44 to permit gas passage therethrough, as will be explained hereinafter. The inner end portion of actuator cam 16 has a cutout configuration that resembles a horizontal elongated slot terminating in an elongated slot extending upwardly and forwardly so as to define an actuator surface 46 that is horizontal with an upwardly directed surface 48. As the actuator cam 16 moves rearwardly (right to left in FIG. 1) the locking member 14 rides on surface 46 and surface 48 and thus moves from the bottom of slot 18 on bolt 10 to the top thereof. This causes locking member 14 to rise up front surface 34 of lug 30 and over top surface 36 as the bolt 10 is freed to move rearwardly relative to the barrel 12.

Figure 2:
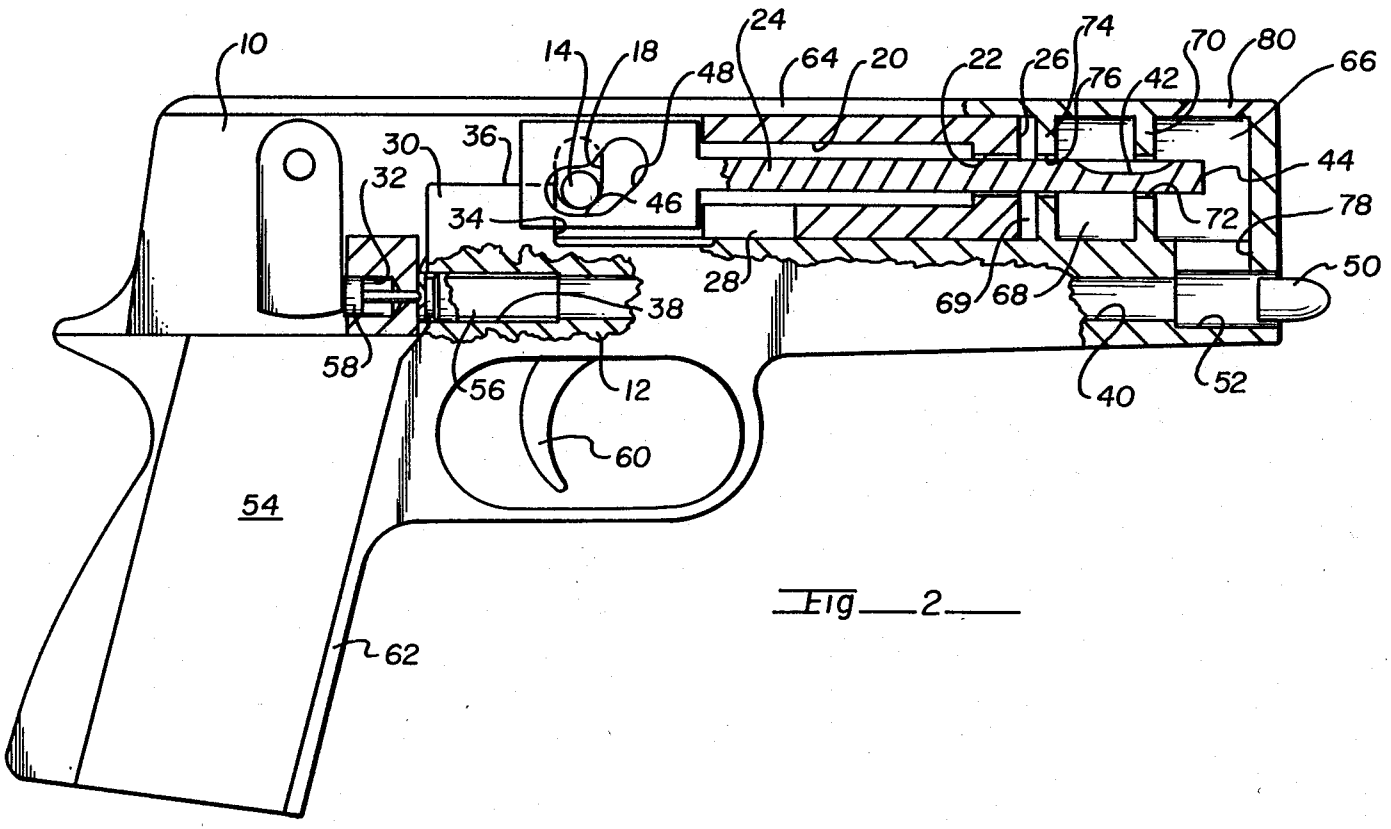
FIG. 2 is a side view partly in section showing the relationship of pistol parts as a fired bullet leaves the bullet muzzle.

With the foregoing explanation of the locking and unlocking actuation, attention is now directed to FIG. 2, wherein bullet 50 is shown leaving muzzle 52 of bore 40 of barrel 12 of pistol 54. Cartridge casing 56 remains locked in chamber 38. Within chamber 32 in bolt 10 is firing pin 58 which had moved forwardly to detonate the cartridge primer in response to a squeeze on trigger 60 in a well known manner and hence not described in detail here. Lug 30 on barrel 12 can be seen, with its forward surface 34 and top surface 36 rearwardly of locking member 14. Locking member 14 is at the bottom of slot 18 in bolt 10 and along horizontal surface 46 on actuator 16, as shown in FIG. 1. As previously explained in discussing the bolt 10, barrel 12, locking member 14 and actuator cam 16 in FIG. 1, a rearward motion of actuator 16 will cause locking member 14 to ride up slope surface 48 and upwardly in slot 18 until it clears top 36 of lug 30. This permits bolt 10 to move rearwardly relative to barrel 12. How this rearward movement of actuator 16 occurs will now be discussed.

Pistol 54 includes a barrel 12 with its bore 40, grip 62 and a frame structure 64 within which bolt 10 and actuator cam move relative to the barrel 12. This structure 64 includes a collection chamber 66 at the muzzle end 52 of barrel bore 40 and an expansion chamber 68 just rearwardly of the collection chamber. Wall 70 separates the two chambers and has a centrally located first aperture 72 through which the stem of actuator 24 protrudes. Expansion chamber 68 also has a rear wall 74 with similar second aperture 76 to permit passage of the stem of actuator 24 also. This rear wall 74 is forward of outer surface 26 of bolt 10 when the bolt is forwardly positioned as shown. Groove 42 on the stem of actuator 24 passes through aperture 72 to form a gas duct from the collection chamber 66 to expansion chamber 68 when the parts are positioned as shown in FIG. 2.

In operation, as bullet 50 leaves muzzle 52, as shown, some gasses from bore 40 behind the bullet 50 pass out the weapon with it Some gasses pass through chamber 68 and some pass out vent 80. Gas pressure on end 44 of the stem of actuator 24 in chamber 66 drives it rearwardly to the unlocking position as shown in FIG. 3.

Figure 3:
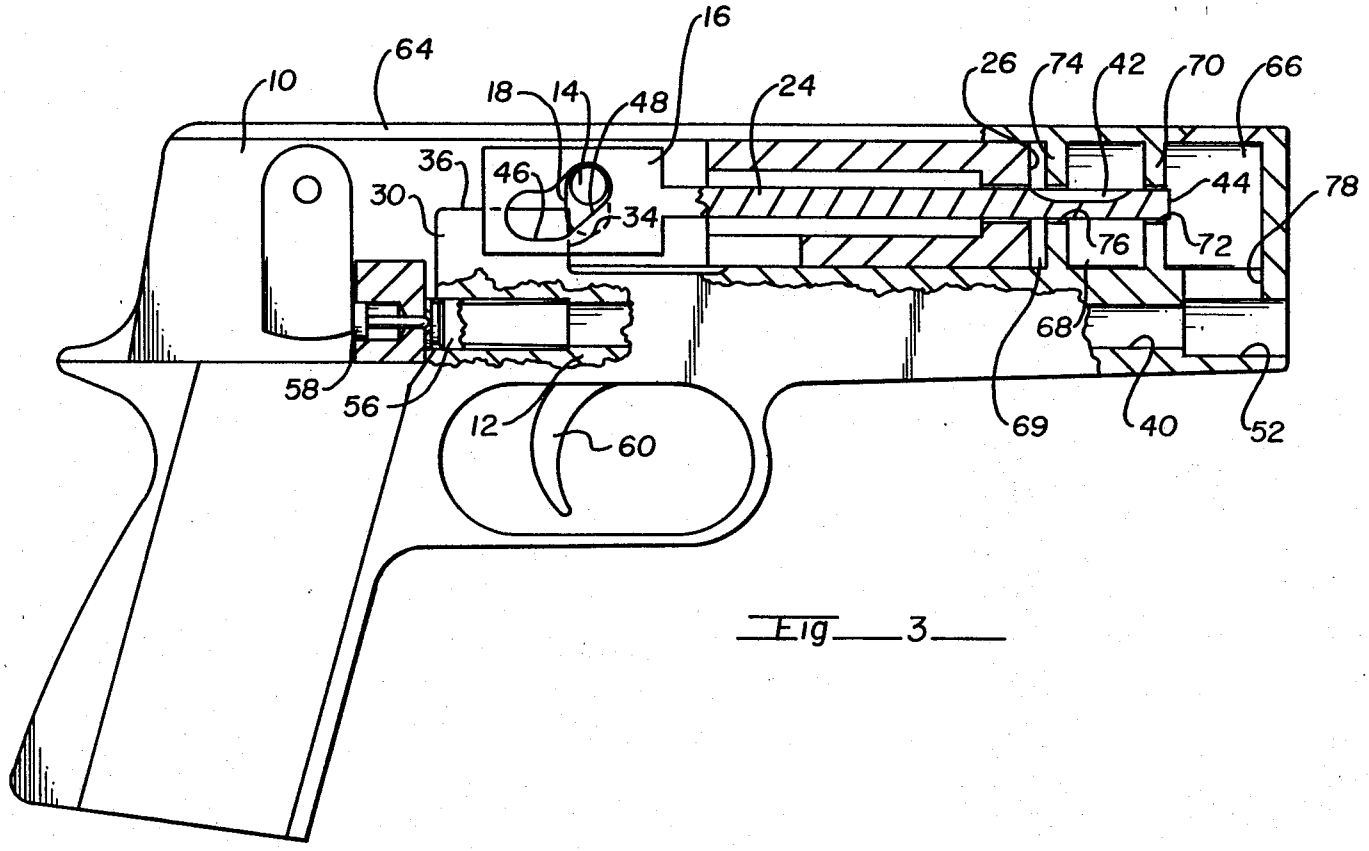
FIG. 3 is a side view partly in section showing the relationship of the parts when the unlocking has been completed and the front end of the bolt is exposed to gas pressure for rearward movement.
Figure 4:
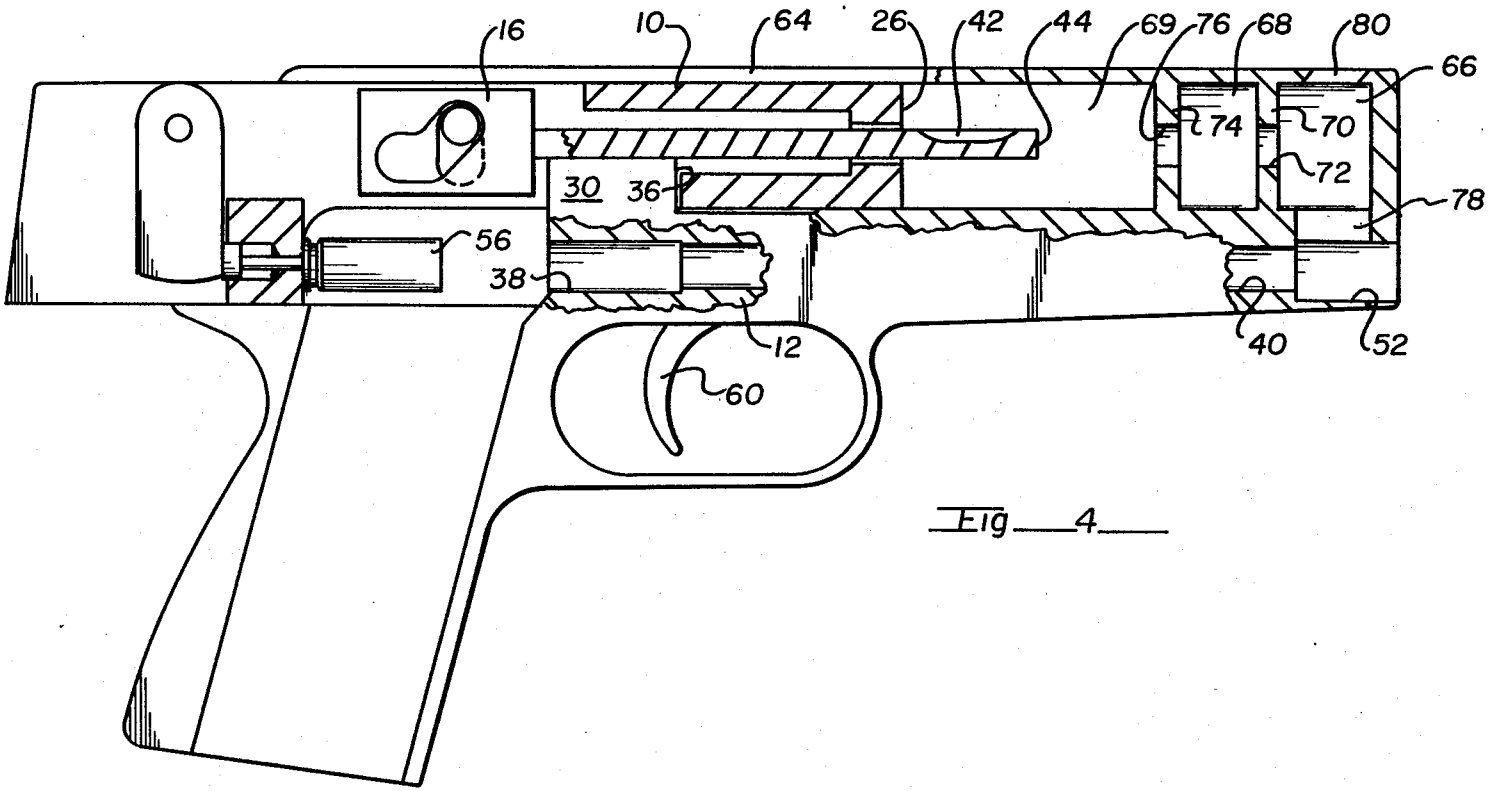
FIG. 4 is a side view partly in section showing the relationship of the parts in full recoil with gas residue exiting the system.

In FIG. 3 the actuator cam 16 has moved rearwardly, causing locking member 14 to move from horizontal surface 46 to slant surface 48 on actuator cam 16 and from the bottom to the top of slot 18 in bolt 10. Gas pressure bears on end 44 of actuator 24 in collection chamber 66 to cause this unlocking movement. It also has moved groove 42 on the stem of actuator 24 partially through the expansion chamber rear wall 74, to permit gas in expansion chamber 68 to expand into piston chamber 69 against forward surface 26 on bolt 10. This drives bolt 10 to full recoil rearward position as shown in FIG. 4. Excess gas in collection chamber 66 exits port 78 and out muzzle 52.

As can be seen in FIG. 4, after actuator cam 16 has raised locking member 14, the locking member 14 passes rearwardly over top surface 36 of barrel lug 30 as bolt 10 moves rearwardly to full recoil. At this point spent casing 56 is ejected and is replaced by a fresh cartridge for the next firing. A drive spring, not shown, drives bolt 10 from its full recoil position in FIG. 4 to its firing position as shown in FIG. 2. Spent gases forwardly of bolt forward surface 26 in piston chamber 69, in expansion chamber 68, and in collection chamber 66 go out exit 80 and through port 78 and out muzzle 52.

Figure 5:
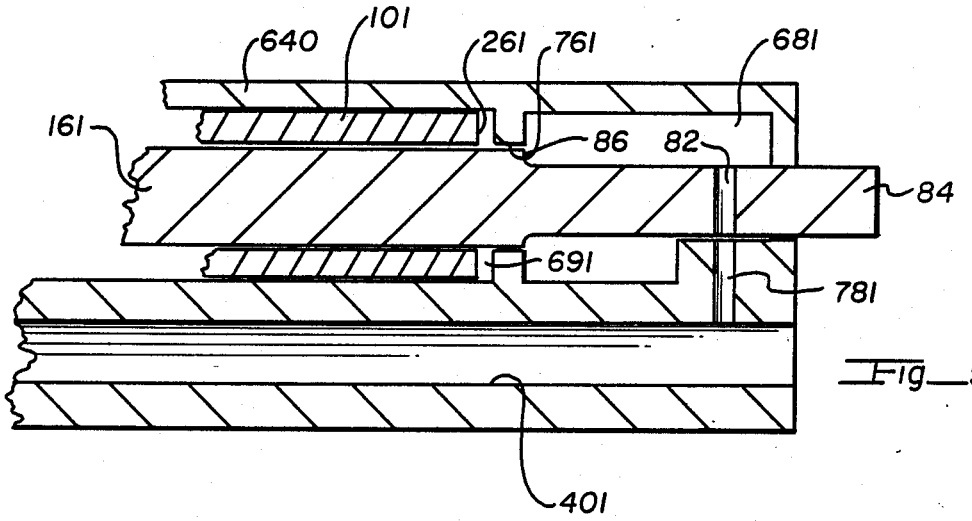
FIG. 5 is a partial sectional view of a second embodiment.

An alternate embodiment without the collection is shown in FIG. 5 in which only one expansion chamber 681 is used. Here the bore 401 has a gas port 781 which passes some of the bullet propellant gases through gas port 82 in actuator 161 and into expansion chamber 681. Actuator 161 has a reduced diameter forward stem 84 resulting in an annular shoulder 86. This area serves as a piston to move actuator 161 rearwardly due to the gas pressure in expansion chamber 681. As port 82 moves rearwardly out of alignment with port 781, further gasses and gas pressure is shut off from the expansion chamber. As actuator 161 moves rearwardly it unlocks the bolt from the barrel as in the first embodiment. The shoulder 86 of actuator 161 passes rearwardly of aperture 761 at the rear of expansion chamber 681, leaving a passageway to the piston chamber 691 in front of bolt 101. The forward surface 261 moves bolt 101 rearwardly due to this increased pressure in chamber 691.

From the foregoing it can be seen that actuator 161 is not the primary mass nor bolt 101 the secondary mass as usually seen in prior art devices. Instead, bolt 101 is the primary mass, there is no secondary mass, and actuator 161 serves to unlock the bolt 101 from barrel 12, not shown in FIG. 4, and as a valve for timing and releasing gas pressure against bolt surface 261 to actuate the bolt.

Having described the preferred embodiment wherein the present invention is used, it is to be understood that variations, improvements and modifications may be made without departing from the spirit of the invention, and that such deviations and alterations are to be considered as part of the present invention as set forth in the following claims.

What is claimed is:

1. A firearm having a bolt, a barrel, and a locking member to selectively lock said bolt and said barrel together when in a locked position and to unlock said bolt and said barrel for relative movement therebetween when said locking member is in an unlocked position, an actuator for moving said locking member between said locked and said unlocked positions, said firearm having a frame structure within which said bolt and said actuator move relative to said barrel, said frame structure having a piston chamber with said bolt therein movable between a forward chambered position and a rearward recoil position, said actuator being operable by pressurized gas from a fired cartridge to expose said piston chamber to said gas, thereby moving said bolt from said forward chambered position to said rearward recoil position, said frame structure including a collection chamber having a port connected to said barrel to divert gas to said collection chamber when a fired bullet passes said port, said frame structure including an expansion chamber connected to said collection chamber through a first aperture therebetween, said actuator having a stem passing through said first aperture when in one position, said first aperture being opened when said stem is moved from said first aperture in response to a gas collected in said collection chamber.

2. A firearm as set forth in claim 1 wherein said piston chamber is connected to said expansion chamber through a second aperture therebetween, said stem passing through said second aperture when in another position, said second aperture being opened when said stem is moved from said second aperture in response to pressurized gas collected in said expansion chamber.

3. A firearm as set forth in claim 2 wherein said stem has a groove therein whereby propellant gases pass therethrough from said collection chamber into said expansion chamber while said stem is in said first aperture.

4. A firearm as set forth in claim 2 wherein said stem has a groove therein whereby propellant gases pass therethrough from said expansion chamber into said piston chamber while said stem is in said second aperture.

5. A firearm having a bolt, a barrel, and a locking member to selectively lock said bolt and said barrel together when in a locked position and to unlock said bolt and said barrel for relative movement therebetween when said locking member is in an unlocked position, an actuator for moving said locking member between said locked and said unlocked positions, said firearm having a frame structure within which said bolt and said actuator move relative to said barrel, said frame structure having a piston chamber with said bolt therein movable between a forward chambered position and a rearward recoil position, said actuator being operable by pressurized gas from a fired cartridge to expose said piston chamber to said gas, thereby moving said bolt from said forward chambered position to said rearward recoil position, said locking member being positioned in a vertically elongated slot in said bolt and in a slot in said actuator containing a horizontal surface and an upwardly extending slant surface whereby rearward movement of said actuator bears said slant surface against said locking member to raise said locking member in said slot in said bolt.

6. A firearm as set forth in claim 5 wherein said locking member rests forwardly of a lug on said barrel to prevent relative movement between said bolt and said barrel and whereby rearward movement of said actuator raises said locking member above said lug to permit rearward movement of said bolt relative to said barrel.

7. A firearm having a bolt, a barrel, and a locking member to selectively lock said bolt and said barrel together when in a locked position and to unlock said bolt and said barrel for relative movement therebetween when said locking member is in an unlocked position, an actuator for moving said locking member between said locked and said unlocked positions, said firearm having a frame structure within which said bolt and said actuator move relative to said barrel, said frame structure having a piston chamber with said bolt therein movable between a forward chambered position and a rearward recoil position, said actuator being operable by pressurized gas from a fired cartridge to expose said piston chamber to said gas, thereby moving said bolt from said forward chambered position to said rearward recoil position, said frame structure having an expansion chamber connected to said piston chamber through an aperture therebetween, said actuator having a stem through said aperture when said bolt is in said locked position, said stem having a groove therein to permit gas pressure communication between said expansion chamber and said piston chamber when said actuator moves said locking member to said unlocked position, said stem being removed from said aperture when said bolt moves to said rearward recoil position.

8. A firearm having a bolt, a barrel, and a locking member to selectively lock said bolt and said barrel together when in a locked position and to unlock said bolt and said barrel for relative movement therebetween when said locking member is in an unlocked position, an actuator for moving said locking member between said locked and said unlocked positions, said firearm having a frame structure within which said bolt and said actuator move relative to said barrel, said frame structure having a piston chamber with said bolt therein movable between a forward chambered position and a rearward recoil position, said actuator being operable by pressurized gas from a fired cartridge to expose said piston chamber to said gas, thereby moving said bolt from said forward chambered position to said rearward recoil position, wherein said locking member interacts with a cam surface on said actuator to move said locking member upwardly out of contact with a front surface of the barrel.

* * * * *